US006367704B1

(12) United States Patent
Mediavilla

(10) Patent No.: US 6,367,704 B1
(45) Date of Patent: Apr. 9, 2002

(54) RAIL FASTENING SYSTEM CONSTRUCTED TO ALLOW PRE-ASSEMBLY OF A RAIL CLIP AND SHOULDER

(75) Inventor: Jose Mediavilla, Kansas City, MO (US)

(73) Assignee: AirBoss Railway Products, Inc., Kansas City, MO (US)

( * ) Notice: Subject to any disclaimer, the term of this patent is extended or adjusted under 35 U.S.C. 154(b) by 0 days.

(21) Appl. No.: 09/605,224

(22) Filed: Jun. 28, 2000

(51) Int. Cl.[7] ..... E01B 9/30

(52) U.S. Cl. ..... 238/310; 238/349; 238/351; 238/352

(58) Field of Search ..... 238/310, 338, 238/349, 350, 351, 352, 315, 343

(56) References Cited

U.S. PATENT DOCUMENTS

| | | | | |
|---|---|---|---|---|
| 31,283 A | | 1/1861 | Weight | |
| 590,108 A | | 9/1897 | Lewis | |
| 961,052 A | | 6/1910 | Warren | |
| 1,039,748 A | | 10/1912 | Hyle et al. | |
| 1,406,074 A | | 2/1922 | Pierson | |
| 1,750,735 A | | 3/1930 | Tupper | |
| 1,772,875 A | | 8/1930 | O'Brien | |
| 2,057,955 A | | 10/1936 | Kahn | |
| 2,770,421 A | | 11/1956 | Wilson | |
| 3,297,253 A | | 1/1967 | Astley et al. | |
| 3,460,756 A | | 8/1969 | Sanson | |
| 3,463,394 A | | 8/1969 | Jones et al. | |
| 3,581,990 A | | 6/1971 | Kirik | |
| 3,610,526 A | | 10/1971 | Burwell | |
| 4,053,107 A | * | 10/1977 | Goderbauer | 238/349 |
| 4,104,483 A | * | 8/1978 | Seeley | 174/138 R |
| 4,267,970 A | * | 5/1981 | Lubbers | 238/310 |
| 4,274,582 A | | 6/1981 | Fee | |
| 4,284,238 A | | 8/1981 | Veroef | |
| 4,313,563 A | | 2/1982 | Young | |
| 4,463,898 A | | 8/1984 | Young et al. | |
| 4,576,334 A | | 3/1986 | Young | |
| 4,688,719 A | * | 8/1987 | Young et al. | 238/351 |
| 4,925,094 A | | 5/1990 | Buekett | |
| 4,928,878 A | * | 5/1990 | Young | 238/351 |
| 5,110,046 A | | 5/1992 | Young | |
| 5,520,330 A | | 5/1996 | Brown et al. | |
| 5,566,882 A | | 10/1996 | Brown et al. | |
| 5,678,762 A | | 10/1997 | Wood et al. | |
| 5,718,376 A | | 2/1998 | Cox et al. | |
| 5,735,458 A | | 4/1998 | Brown et al. | |
| 5,820,021 A | | 10/1998 | Rex | |
| 5,865,370 A | | 2/1999 | Sonneville et al. | |

FOREIGN PATENT DOCUMENTS

| | | | | |
|---|---|---|---|---|
| AU | 226776 | | 6/1959 | |
| AU | 265930 | | 10/1963 | |
| AU | 415933 | | 10/1969 | |
| GB | 2152120 A | * | 7/1985 | E01B/9/30 |

* cited by examiner

*Primary Examiner*—S. Joseph Morano
*Assistant Examiner*—Frantz F. Jules
(74) *Attorney, Agent, or Firm*—Shook, Hardy & Bacon L.L.P.

(57) ABSTRACT

A rail fastening system including a cast shoulder and an elastic rail spring clip for applying a holding force to an insulator and a rail. The spring clip includes a pair of compressible arms for exerting a rail hold down force and a substantially horizontal base portion for application to the cast shoulder. The cast shoulder includes an anchoring portion, a receiving portion including converging opposing sides angled to define a throat having a width less than a decompressed width of the spring clip arms, and notches on the sides adjacent to the throat. In practice, the spring clip is applied to the cast shoulder such that two spring clip arms contact and move along the converging sides causing the spring clip arms to be compressed by the sides. When the arms move beyond the throat, the arms spring outwardly into the notch. The notch provides a catch that prevents any backward migration such that the elastic rail spring clip and the cast shoulder can be pre-assembled at a remote location, requiring less labor at the rail installation site.

4 Claims, 3 Drawing Sheets

FIG. 3.
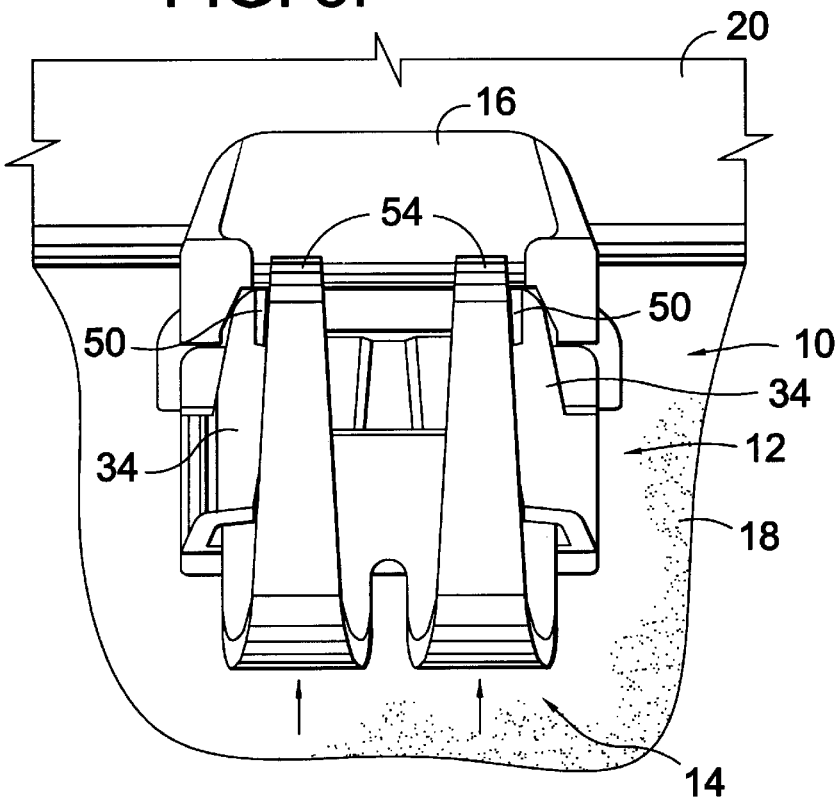
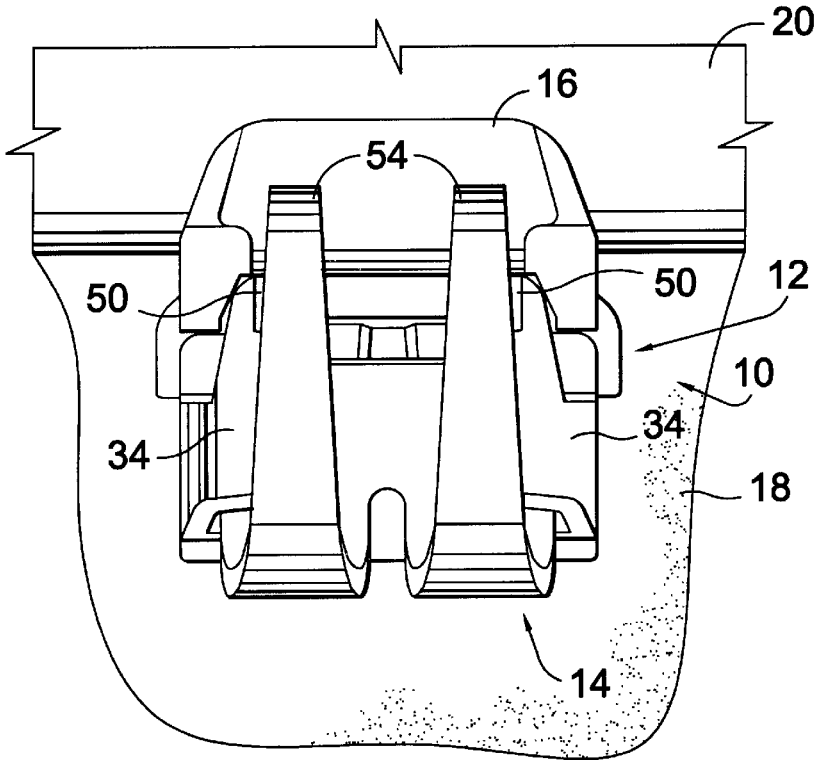
FIG. 4.

RAIL FASTENING SYSTEM CONSTRUCTED TO ALLOW PRE-ASSEMBLY OF A RAIL CLIP AND SHOULDER

BACKGROUND OF THE INVENTION

1. Field of the Invention

In general, this invention relates to a rail fastening system, and in particular, to a method and device for securing a rail to a concrete rail tie.

2. Description of the Related Art

Conventional fastening systems for concrete rail ties generally have a cast shoulder, an elastic rail spring clip, and a rail insulator. In this conventional system, the tie is formed with a portion of the cast shoulder imbedded into the tie. To secure the rail to the tie, the elastic rail spring clip is applied to the cast shoulder such that spring arms of the elastic spring clip press the insulator downwardly against a top portion of the rail flange to exert a rail hold down force. At the same time, the body or base of the elastic rail spring clip is secured to the cast shoulder to prevent movement of the rail flange.

This conventional system requires the loose components such as the insulator and the elastic rail spring clip to be wholly installed at the construction site. This process requires a large labor force and considerable time to place the components into a working position. Accordingly, the handling and application of the loose rail fastening components typically comprises a significant part of the overall cost of the installation of concrete railroad ties and rails. Moreover, the loose parts can be easily lost, misplaced or stolen.

In addition to the labor cost of installation, the rail fastening assembly may need to be removed after the rail has been installed to allow the rail to be serviced. Currently, the conventional method requires the elastic rail spring clip element to be "sprayed" completely out of the cast shoulder to release the other components. After servicing the rail, additional effort must be invested to reset and secure the spring clip, similar to the effort required to mount the spring clip originally.

Thus, there is a need for a rail fastening system which facilitates the installation of the rail fastening components, reduces the cost of installing rails on concrete ties and facilitates and reduces the cost of post-installation rail servicing.

SUMMARY OF THE INVENTION

The present invention satisfies the above-described need by providing a method and device for coupling a rail to a railroad tie including a cast shoulder and an elastic spring clip which can be pre-assembled together to reduce the work required at the track site and minimize loss of parts.

Generally described, the present invention provides a fastening system for mounting a rail to a rail tie which includes a spring clip having a pair of arms that can be deflected toward one another from a normal non-deflected position wherein the arms define a normal width of the spring clip. The fastening system also includes a shoulder having an anchoring portion adapted to be anchored to the rail, a receiving portion for receiving the spring clip, and a notch. The receiving portion includes a pair of opposing sides angled to converge as they extend toward the rail and providing a throat location at which the distance between the opposing sides is less than the normal width of the spring clip. The notches provide a width greater than the distance between the opposing sides at the throat location to thereby provide a catch structure which prevents movement of the spring clip out of the receiving portion in a direction away from the rail.

In another aspect of the present invention, the invention provides a method for pre-assembling an elastic rail spring clip to a shoulder. The elastic spring clip includes a substantially horizontal base as well as the two spring arms. The method involves application of the elastic rail spring clip to the receiving portion of the shoulder and movement of the clip into the receiving portion until the spring clip arms reach and pass the throat. The elastic rail spring clip arms compress as they move along the converging sides toward the throat, and the arms thereafter spring outwardly and are caught in the notches.

By providing the converging sides and the notches adjacent to the throat location of the sides, the present invention allows the spring clip and cast shoulder to be pre-assembled prior to the on-site final installation of the rail to the rail tie, thereby reducing the amount of field labor required to install the rail tie. Additionally, the notch prevents a complete decoupling of the spring clip from the cast shoulder thereby reducing the labor required to remove and reattach the spring clip once the rail is installed.

BRIEF DESCRIPTION OF THE DRAWING.

The present invention is described in detail below with reference to the attached figures, wherein:

FIG. 3 is top plan view of the interconnection between the elastic rail spring clip and the cast shoulder of the present invention illustrating the clip pre-assembled to the cast shoulder prior to final installation of the rail fastening system;

FIG. 4 is top plan view of the interconnection between the elastic rail spring clip and the cast shoulder of the present invention similar to FIG. 3 but illustrating the fully installed position of the rail fastening system of the present invention;

DETAILED DESCRIPTION OF INVENTION

Figure 1:
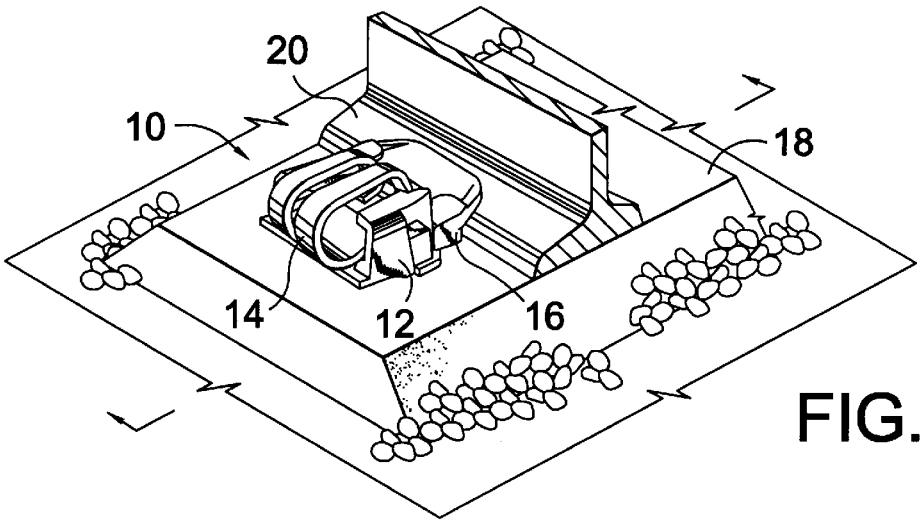
FIG. 1 is perspective view of a rail fastening system constructed to a preferred embodiment of the present invention.

FIG. 1 illustrates a rail fastening system constructed according to the present invention and denoted generally by the reference numeral 10. System 10 includes a cast shoulder 12, an elastic rail spring clip 14, and an insulator 16. When applied to a railroad tie 18, which is preferably made of concrete or similar material, system 10 secures a railroad rail 20 to the tie 18. Preferably, two of the rail fastening systems 10 are used for each tie 18 on each rail 20, with one fastening system on the field side of each rail and another fastening system on the gauge side of each rail. The ties 18 are spaced apart and extend transversely to the rails 20 in the usual manner.

Figure 2:
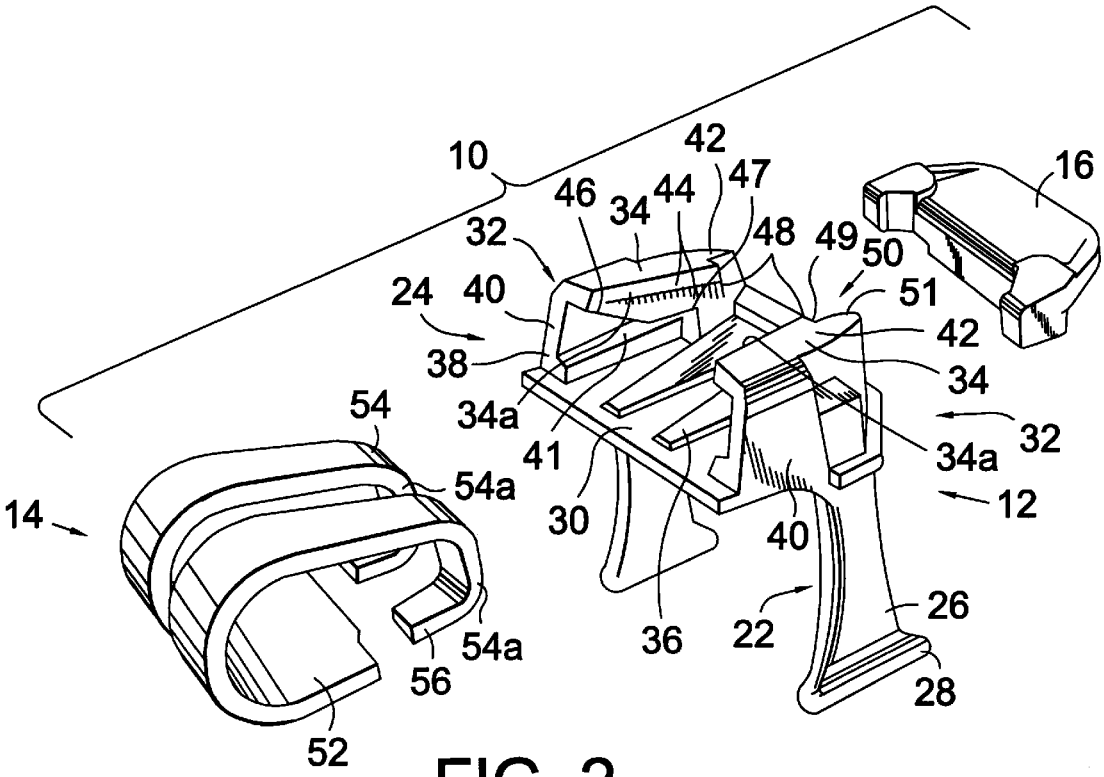
FIG. 2 is an exploded perspective view showing the interconnection of an elastic rail spring clip, an insulator and a cast shoulder of the present invention.

With reference to FIG. 2, the cast shoulder 12 of the present invention includes an anchoring portion 22 and a receiving portion 24. Anchoring portion 22 preferably includes two vertically extending legs 26 having flared lower ends 28 for attachment with concrete railroad tie 18. Preferably, the legs 26 are embedded in the tie 18 when the tie is cast. Receiving portion 24 includes a bottom surface 30 and two opposing sides 32. Bottom surface 30 is generally horizontal and is connected with the anchoring portion 22 and with the opposing sides 32. Preferably, bottom surface 30 also includes a ramped guide piece 36 for receiving elastic rail spring clip 14.

Opposing sides 32 each include a base 38 mounted on top of the bottom surface 30 and a more narrow wall 40 extending upwardly from the base 38. Preferably, because the width of the base 38 is greater than the width of the wall 40, the wall 40 extends from the outer edge of the base 38, relative to center of the bottom surface 30, such that the top of each base 38 provides a horizontal ledge surface 41 for accepting the elastic rail spring clip 14. Projecting inwardly toward the center of the shoulder 12 from the top of each of the opposing sides 32 is a flange piece 34. Preferably, each flange piece 34 includes a generally horizontal top surface 42 and an inwardly facing surface 44. The underside portion of each flange 34 has an inclined portion 46 which slopes downwardly as it extends toward the rail and connects with a generally horizontal portion 47 which closely overlies the elastic rail spring clip base when the clip is installed.

Flange piece 34 is arranged in a special configuration. On the top portion of each flange 34, a side edge 34*a* of the flange angles inwardly toward an axis centered between the opposing sides 32. The edges 34*a* converge as they extend toward the rail 20 such that the distance between the edges of the two flange pieces 34 decreases from the back of the receiving portion 24 to the front relative to the location of the rail 20. The convergence of the edges is such that the distance between the two edges 34*a* progressively decreases. The minimum distance between edges 34*a* is at a throat 48 which has a width less than the undeflected width of the arms of the clip 14.

Adjacent to the throat 48, each flange piece 34 is provided with a notch 50 which is recessed into edge 34*a*. Each notch 50 is bounded by two substantially vertical surfaces perpendicular to one another. Preferably, the notch 50 defines a square cut-out having a first surface 49, generally perpendicular to the vertical wall 32, which functions as a catch to impede the backward migration of the elastic spring clip 14 once the tips of its arms have passed beyond the throat 48. Additionally, the notch 50 includes a second surface 51, generally parallel to wall 32, which is of a sufficient length to allow the spring clip arms 54 to rest within the notch 50 without substantially extending beyond the receiving portion 24. As would be readily understood, structures having rounded or angled edges between the surfaces of the notch 50 are considered within the scope of the present invention, as are other configurations and arrangements of the edges 34*a*.

Preferably, the bottom surface 30, opposing sides 32 and flange pieces 34 are cast as a single piece. As is understood by those skilled in the art, the implementation of the bottom surface 30, opposing sides 32, and/or flange pieces 34 as separate components connected to one another is within the scope of the present invention.

With continued reference to FIG. 2, elastic rail spring clip 14 preferably includes a substantially horizontal base piece 52, two spaced apart arms 54 extending from the base 52 and two substantially horizontal tips 56 at the free ends of the arms 54. The tips are curved back generally toward the base 52. Preferably, spring clip arms 54 are compressible toward one another from a noncompressed or normal width to a compressed width by the application of a sufficient compression force.

Figure 5:
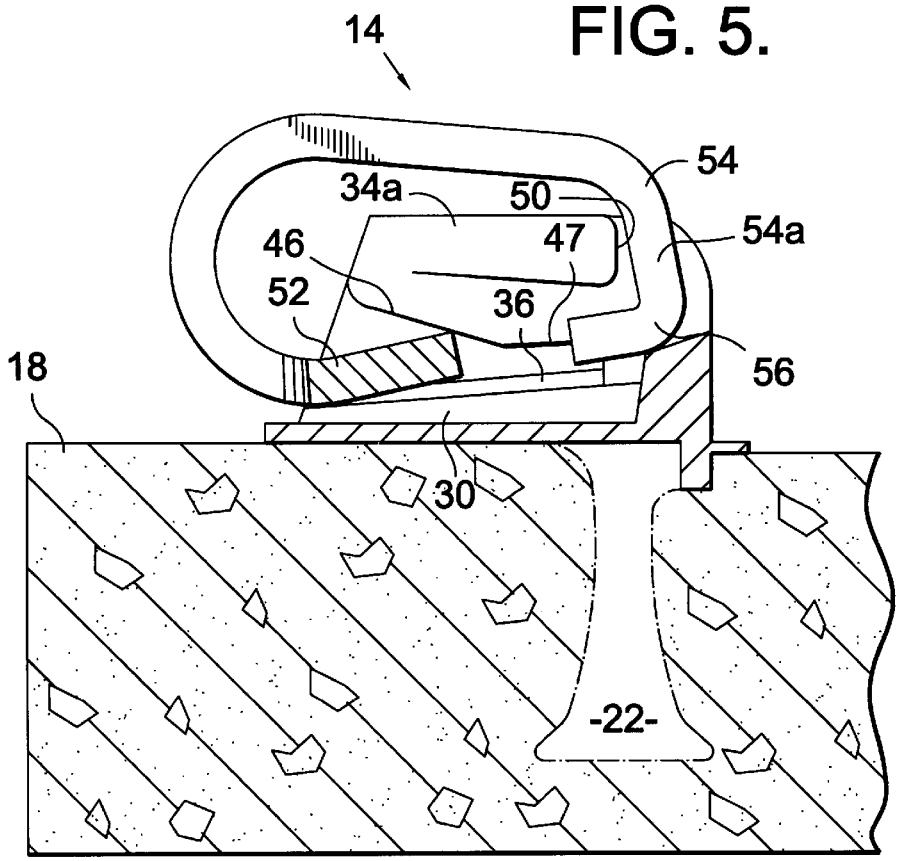
FIG. 5 is a sectional view of the interconnection between the elastic rail spring clip and the cast shoulder illustrating the spring clip pre-assembled to the cast shoulder prior to final installation of the rail fastening system of the present invention.

With reference to FIGS. 3, 4, 5 and 6, the present invention allows pre-assembly of the elastic rail spring clip 14 to the cast shoulder 12 prior to the onsite implementation of the rail fastening system. The elastic rail spring clip 14 is applied into the back of the receiving portion 24 of cast shoulder 12 (the side opposite the rail 20) such that the base 52 passes between the vertical walls 40, and above the horizontal surfaces 41. As illustrated in FIG. 5, the bottom of base portion 52 of the elastic rail spring clip 14 contacts the top of the horizontal surface 41 and guide piece 36 as the spring clip progresses forwardly. Additionally, base portion 52 contacts and moves along surface 46. Inner surface 44, base 38 and guide piece 36 serve to guide and secure the elastic spring clip 14 as it passes into the cast shoulder 12.

After entering the back of the receiving portion, the elastic rail spring clip 14 continues to move into the cast shoulder 12 to a point where the substantially vertical leading ends 54*a* (see FIGS. 5 and 6) of the decompressed spring clip arms 54 contact the edges 34*a*, whereafter additional movement of the clip causes arms 54 to deflect toward one another. The spring clip arms 54 are gradually compressed as they move along the converging edges 34*a* toward the throat 48. After the leading ends of arms 54 pass the throat, the compressive force is removed and the arms 54 then spring outwardly in the notches 50 against surfaces 51. It should be understood that alternative methods of compressing the spring clip arms 54 are within the scope of the present invention.

As best illustrated in FIGS. 3 and 5, upon moving past throat 48, the spring clip arms 54 decompress, causing the arms to enter and rest in notches 50. Surface 49 provides a stop that engages the arms and prevents any backward migration of the decompressed spring clip 14. As illustrated in FIG. 3, the length of the second surface 51 allows the spring clip 14 to rest decompressed without extending substantially beyond the forward edge of the receiving portion 24. At this time, the system 10 has reached the preinstallation position where the clip 14 is partially assembled to the cast shoulder 12. As illustrated in FIG. 5, the shoulder 12 is imbedded into the concrete tie 18 and taken to the construction site. The cast shoulder 12 may be imbedded into the concrete tie 18 either prior to or after being coupled with the elastic spring clip 14.

Figure 6:
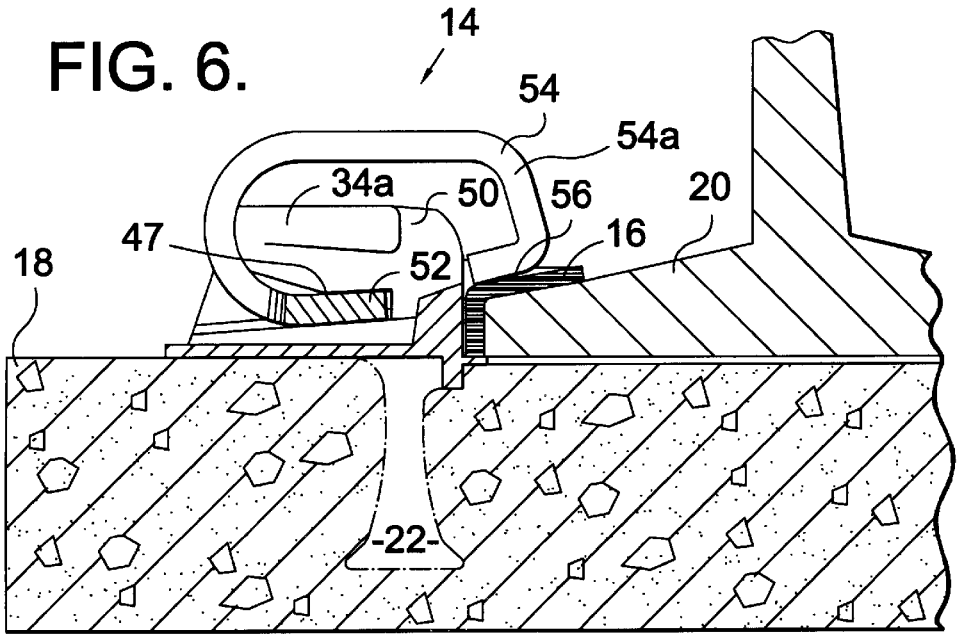
FIG. 6 is a sectional view of the interconnection between the elastic rail spring clip and the cast shoulder of the present invention similar to FIG. 5 but illustrating the spring clip fully applied to the cast shoulder in the fully installed position of the rail fastening system.

As illustrated in FIGS. 4 and 6, at the construction site, rail insulator 16 is placed on the rail flange 20. Elastic spring clip 14 is then driven onto the insulator and rail flange such that the tip portions 56 of the arms contact and exert a rail hold down force on the insulator 16 and rail. Additionally, as the spring clip 14 moves forward, the base portion 52 of the spring clip 14 enters the space beneath surface 47 and is closely received therein to assure that the arms 54 exert a strong force downwardly to secure the rail 20 in place. Thus, the only additional assembly required at the construction site is the placement of the insulator 16 and the provision of a driving force to the elastic rail spring clip 14 to fully assemble it.

With reference to FIGS. 3 and 4, the rail fastening system 10 also facilitates the disengagement of the rail hold down force from the elastic spring clip 14 without decoupling the spring clip 14 from the cast shoulder 12. To disengage the spring clip force, a backward migration force is applied to the spring clip 14 such that it the elastic spring clip arms 54 at the most only minimally contact the insulator 16 and the rail hold down force is removed. Preferably, the backward migration force is sufficient to cause the spring clip arms 54 to reside within the notches 50 such that first surfaces 49 prevent any further backward migration. The second surfaces 51 allow the spring clip arms 54 to reside in the notches 50 without extending unduly beyond the edge of the bottom surface 30. To reapply the hold-down force, a driving force is applied to the back of the spring clip to push it forward such that the tips 56 of the spring clip arms 54 again contact the insulator and secure the rail 20.

The present invention allows for the partial pre-installation coupling of the elastic rail spring clip and the cast shoulder. Accordingly, some of the labor intensive actions can be accomplished prior to shipping the rail fastening system and concrete ties to the rail site thereby reducing the more costly labor required in the field to secure a rail to the tie. Further, the clips 14 are matched one to one with the shoulders 12 by being pre-assembled to them. Thus, clips are not subject to being misplaced as can occur when they are shipped to the site separately. Additionally, the present invention allows a previously mounted rail to be serviced/replaced without requiring a complete decoupling of the rail fastening system, thereby reducing the labor and time required to carry out such work.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

We claim:

1. A fastening system for mounting a rail to a rail tie, comprising:

a spring clip having a pair of arms that can be deflected toward one another from a normal nondeflected position wherein the arms define a normal width of the spring clip, said spring clip having a base from which said arms extend; and a shoulder comprising:

an anchoring portion adapted to be anchored to the rail tie, a receiving portion for receiving the base of said spring clip in a partially assembled position thereof and in a fully assembled position thereof, the receiving portion having a pair of opposing sides angled to converge toward the rail and providing a throat location at which the distance between the opposing sides is less than the normal width of the spring clip so that the arms are deflected toward one another as they move along said sides toward the throat location, said spring clip being in the partially assembled position thereof when received in the receiving portion such that the arms have moved to barely pass the throat location, and a pair of notches adjacent to the throat location for receiving the arms when the arms move past the throat location, the notches defining a width greater than the distance between the opposing sides at the throat location to thereby allow the arms to assume the non-deflected position and thereafter prevent movement of the spring clip out of the receiving portion in a direction away from the rail to retain the spring clip in the partially assembled position thereof, said spring clip being movable thereafter from the partially assembled position to the fully assembled position.

2. The rail fastening system recited in claim 1, wherein the opposing sides each includes a wall coupled with a recessed area such that a width of the recessed area is wider than a width of the wall to present a ledge surface for guiding the spring clip into said receiving portion.

3. The rail fastening system recited in claim 2, wherein the opposing sides each includes an upper portion having a first downwardly inclined surface and a second substantially horizontal surface, such that an area between said ledge and the downwardly inclined surface and said substantially horizontal surface of the upper portion present a coupling guide for the spring clip.

4. A fastening system for mounting a rail to a rail tie, comprising:

a spring clip having a pair of arms that can be deflected toward one another from a normal nondeflected position wherein the arms define a normal width of the spring clip, said spring clip having a base from which said arms extend; and a shoulder comprising:

an anchoring portion adapted to be anchored to the rail tie, a receiving portion for receiving the base of said spring clip in a partially assembled position thereof and in a fully assembled position thereof, the receiving portion having a pair of opposing sides angled to converge toward the rail and providing a throat location at which the distance between the opposing sides is less than the normal width of the spring clip so that the arms are deflected toward one another as they move along said sides toward the throat location, said spring clip being in the partially assembled position thereof when received in the receiving portion such that the arms have moved to barely pass the throat location, and a pair of notches adjacent to and forward of the throat location for receiving the arms when the arms move past the throat location, the notches defining a width greater than the distance between the opposing sides at the throat location to thereby allow the arms to assume the non-deflected position and thereafter prevent movement of the spring clip out of the receiving portion in a direction away from the rail to retain the spring clip in the partially assembled position thereof and defining a depth sufficient to permit the arms to be received in the notches so that the arms do not extend substantially beyond a forward edge of the receiving portion in the partially assembled position, said spring clip being movable thereafter from the partially assembled position to the fully assembled position.

* * * * *